US006672975B1

(12) United States Patent
Galloway

(10) Patent No.: US 6,672,975 B1
(45) Date of Patent: Jan. 6, 2004

(54) GOLF CLUB HEAD

(75) Inventor: J. Andrew Galloway, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/248,669

(22) Filed: Feb. 6, 2003

(51) Int. Cl.[7] ..... A63B 53/04
(52) U.S. Cl. ..... 473/342; 473/346; 473/349
(58) Field of Search ..... 473/324, 342, 473/345, 346, 347, 348, 349, 350

(56) References Cited

U.S. PATENT DOCUMENTS 1,167,387 A 1/1916 Daniel
1,638,916 A 8/1927 Butchart
1,780,625 A 11/1930 Mattern
2,750,194 A 6/1956 Clark
3,692,306 A 9/1972 Glover (List continued on next page.)

*Primary Examiner*—Sebastiano Passaniti
(74) *Attorney, Agent, or Firm*—Michael A. Catania; Elaine H. Lo

(57) ABSTRACT

A golf club head (20) having a body (22), a striking plate (24) and a frame (26) is disclosed herein. The body (22) is preferably composed of a low-density material. The frame (26) has a plurality of arms (42*a–d*) for attachment to the striking plate (24). The golf club head (20) preferably has a volume between 300 cubic centimeters and 500 cubic centimeters. The golf club head (20) preferably has a mass between 105 grams and 300 grams.

10 Claims, 4 Drawing Sheets

U.S. PATENT DOCUMENTS 3,897,066 A 7/1975 Belmont
3,937,474 A 2/1976 Jepson et al.
3,970,236 A 7/1976 Rogers
3,975,023 A 8/1976 Inamori
3,989,248 A 11/1976 Campau
4,021,047 A 5/1977 Mader
4,398,965 A 8/1983 Campau
4,568,088 A 2/1986 Kurahashi
4,872,685 A 10/1989 Sun
4,877,249 A 10/1989 Thompson
5,024,437 A 6/1991 Anderson
5,094,383 A 3/1992 Anderson
5,106,094 A 4/1992 Desboilles et al.
5,163,682 A 11/1992 Schmidt et al.
5,193,811 A 3/1993 Okumoto et al.
5,255,918 A 10/1993 Anderson
5,261,663 A 11/1993 Anderson
5,261,664 A 11/1993 Anderson
5,282,624 A 2/1994 Viste
5,310,185 A 5/1994 Viollez et al.
5,318,300 A 6/1994 Schmidt et al.
5,344,140 A 9/1994 Anderson et al.
5,346,216 A 9/1994 Aizawa
5,377,986 A 1/1995 Viollaz et al.
5,398,935 A 3/1995 Katayama
5,410,798 A 5/1995 Lo
5,425,538 A 6/1995 Vincent et al.
5,451,058 A * 9/1995 Price et al. ..... 473/340
5,464,210 A 11/1995 Davis et al.
5,474,296 A 12/1995 Schmidt et al.
5,499,814 A 3/1996 Lu
5,516,107 A 5/1996 Okumoto et al.
5,547,427 A 8/1996 Rigal et al.
5,570,886 A 11/1996 Rigal et al.
5,624,331 A 4/1997 Lo et al.
5,743,813 A 4/1998 Chen et al.
5,776,011 A 7/1998 Su et al.
5,830,084 A 11/1998 Kosmatka
5,863,261 A 1/1999 Eggiman
5,888,148 A 3/1999 Allen
6,010,411 A 1/2000 Reyes
6,017,280 A * 1/2000 Hubert ..... 473/324
6,033,319 A * 3/2000 Farrar ..... 473/313
6,048,278 A 4/2000 Meyer et al.
6,083,118 A * 7/2000 Martins et al. ..... 473/334
6,146,571 A 11/2000 Vincent et al.
6,149,534 A 11/2000 Peters et al.
6,152,833 A 11/2000 Werner et al.
6,165,081 A 12/2000 Chou
6,354,962 B1 3/2002 Galloway et al.
6,368,234 B1 4/2002 Galloway
6,386,990 B1 5/2002 Reyes et al.
6,398,666 B1 6/2002 Evans et al.
6,440,011 B1 8/2002 Hocknell et al.
6,471,604 B2 10/2002 Hocknell et al.
6,491,592 B2 12/2002 Cackett et al.

* cited by examiner

GOLF CLUB HEAD

CROSS REFERENCE TO RELATED APPLICATIONS

[Not Applicable]

FEDERAL RESEARCH STATEMENT

[Not Applicable]

BACKGROUND OF INVENTION

1. Field of the Invention

The present invention relates to a golf club head. More specifically, the present invention relates to a golf club head with an external frame composed of a high strength material and a body composed of a low density material.

2. Description of the Related Art

When a golf club head strikes a golf ball, large impacts are produced that load the club head face and the golf ball. Most of the energy is transferred from the head to the golf ball, however, some energy is lost as a result of the collision. The golf ball is typically composed of polymer cover materials (such as ionomers) surrounding a rubber-like core. These softer polymer materials having damping (loss) properties that are strain and strain rate dependent which are on the order of 10–100 times larger than the damping properties of a metallic club face. Thus, during impact most of the energy is lost as a result of the high stresses and deformations of the golf ball (0.001 to 0.20 inch), as opposed to the small deformations of the metallic club face (0.025 to 0.050 inch).

A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Campau, U.S. Pat. No. 4,398,965, for a Method Of Making Iron Golf Clubs With Flexible Impact Surface, which discloses a club having a flexible and resilient face plate with a slot to allow for the flexing of the face plate. The face plate of Campau is composed of a ferrous material, such as stainless steel, and has a thickness in the range of 0.1 inches to 0.125 inches.

Another example is Eggiman, U.S. Pat. No. 5,863,261, for a Golf Club Head With Elastically Deforming Face And Back Plates, which discloses the use of a plurality of plates that act in concert to create a spring-like effect on a golf ball during impact. A fluid is disposed between at least two of the plates to act as a viscous coupler.

Yet another example is Jepson etal, U.S. Pat. No. 3,937,474, for a Golf Club With A Polyurethane Insert. Jepson discloses that the polyurethane insert has a hardness between 40 and 75 shore D.

Still another example is Inamori, U.S. Pat. No. 3,975,023, for a Golf Club Head With Ceramic Face Plate, which discloses using a face plate composed of a ceramic material having a high energy transfer coefficient, although ceramics are usually harder materials.

Chen et al., U.S. Pat. No. 5,743,813 for a Golf Club Head, discloses using multiple layers in the face to absorb the shock of the golf ball. One of the materials is a non-metal material.

Lu, U.S. Pat. No. 5,499,814, for a Hollow Club Head With Deflecting Insert Face Plate, discloses a reinforcing element composed of a plastic or aluminum alloy that allows for minor deflecting of the face plate which has a thickness ranging from 0.01 to 0.30 inches for a variety of materials including stainless steel, titanium, KEVLAR®, and the like.

Yet another Campau invention, U.S. Pat. No. 3,989,248, for a Golf Club Having Insert Capable Of Elastic Flexing, discloses a wood club composed of wood with a metal insert.

Although not intended for flexing of the face plate, Anderson, U.S. Pat. Number 5,344,140, for a Golf Club Head And Method Of Forming Same, discloses use of a hot forged material for the face plate. The face plate of Anderson may be composed of several hot forged metal materials including steel, copper and titanium. The hot forged plate has a uniform thickness of between 0.090 and 0.1 30 inches.

Another invention directed toward forged materials in a club head is Su etal., U.S. Pat. No. 5,776,011 for a Golf Club Head. Su discloses a club head composed of three pieces with each piece composed of a forged material. The main objective of Su is to produce a club head with greater loft angle accuracy and reduce structural weaknesses. Aizawa, U.S. Pat. No. 5,346,216 for a Golf Club Head, discloses a face plate having a curved ball hitting surface.

U.S. Pat. No. 6,146,571 to Vincent, etal., discloses a method of manufacturing a golf club head wherein the walls are obtained by injecting a material such as plastic over an insert affixed to a meltable core. The core has a melt point lower than that of the injectable plastic material so that once the core is removed, an inner volume is maintained to form the inner cavity. The insert may comprise a resistance element for reinforcing the internal portion of the front wall of the shell upon removal of the core where the reinforcement element is comprised of aluminum with a laterally extending portion comprised of steel.

U.S. Pat. No. 6,149,534 to Peters, etal., discloses a golf club head having upper and lower metal engagement surfaces formed along a single plane interface wherein the metal of the lower surface is heavier and more dense than the metal of the upper surface.

U.S. Pat. Nos. 5,570,886 and 5,547,427 to Rigal, etal., disclose a golf club head of molded thermoplastic having a striking face defined by an impact-resistant metallic sealing element. The sealing element defines a front wall of the striking surface of the club head and extends upward and along the side of the impact surface to form a neck for attachment of the shaft to the club head. The sealing element preferably being between 2.5 and 5 mm in thickness.

U.S. Pat. No. 5,425,538 to Vincent, etal., discloses a hollow golf club head having a steel shell and a composite striking surface composed of a number of stacked woven webs of fiber.

U.S. Pat. No. 5,377,986 to Viollaz, etal., discloses a golf club head having a body composed of a series of metal plates and a hitting plate comprised of plastic or composite material wherein the hitting plate is imparted with a forwardly convex shape. Additionally, U.S. Pat. No. 5,310,185 to Violaz, etal., discloses a hollow golf club head having a body composed of a series of metal plates, a metal support plate being located on the front hitting surface to which a hitting plate comprised of plastic or composite is attached. The metal support plate has a forwardly convex front plate associated with a forwardly convex rear plate of the hitting plate thereby forming a forwardly convex hitting surface.

U.S. Pat. No. 5,1 06,094 to Desboilles, etal., discloses a golf club head having a metal striking face plate wherein the striking face plate is a separate unit attached to the golf club head with a quantity of filler material in the interior portion of the club head.

U.S. Pat. No. 4,568,088 to Kurahashi discloses a wooden golf club head body reinforced by a mixture of wood-plastic composite material. The wood-plastic composite material being unevenly distributed such that a higher density in the range of between 5 and 1 5 mm lies adjacent to and extends substantially parallel with the front face of the club head.

U.S. Pat. No. 4,021,047 to Mader discloses a golf club wherein the sole plate, face plate, heel, toe and hosel portions are formed as a unitary cast metal piece and wherein a wood or composite crown is attached to this unitary piece thereby forming a hollow chamber in the club head.

U.S. Pat. No. 5,624,331 to Lo, et al. discloses a hollow metal golf club head where the metal casing of the head is composed of at least two openings. The head also contains a composite material disposed within the head where a portion of the composite material is located in the openings of the golf club head casing.

U.S. Pat. No. 1,167,387 to Daniel discloses a hollow golf club head wherein the shell body is comprised of metal such as aluminum alloy and the face plate is comprised of a hard wood such as beech, persimmon or the like. The face plate is aligned such that the wood grain presents endwise at the striking plate.

U.S. Pat. No. 3,692,306 to Glover discloses a golf club head having a bracket with sole and striking plates formed integrally thereon. At least one of the plates has an embedded- elongate tube for securing a removably adjustable weight means.

U.S. Pat. No. 5,410,798 to Lo discloses a method of manufacturing a composite golf club head using a metal casing to which a laminated member is inserted. A sheet of composite material is subsequently layered over the openings of the laminated member and metal casing to close off the openings in the top of both. An expansible pocket is then inserted into the hollow laminated member comprising sodium nitrite, ammonium chloride and water causing the member to attach integrally to the metal casing when the head is placed into a mold and heated.

U.S. Pat. No. 4,877,249 to Thompson discloses a wood golf club head embodying a laminated upper surface and metallic sole surface having a keel. In order to reinforce the laminations and to keep the body from delaminating upon impact with an unusually hard object, a bolt is inserted through the crown of the club head where it is connected to the sole plate at the keel and tightened to compress the laminations.

U.S. Pat. No. 2,750,194 to Clark discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

U.S. Pat. No. 5,193,811 to Okumoto, et al. discloses a wood type club head body comprised primarily of a synthetic resin and a metallic sole plate. The metallic sole plate has on its surface for bonding with the head body integrally formed members comprising a hosel on the heel side, weights on the toe and rear sides and a beam connecting the weights and hosel. Additionally, U.S. Pat. No. 5,516,107 to Okumoto, et al., discloses a golf club head having an outer shell, preferably comprised of synthetic resin, and metal weight member/s located on the interior of the club head.

A foamable material is injected into the hollow interior of the club to form the core. Once the foamable material has been injected and the sole plate is attached, the club head is heated to cause the foamable material to expand thus holding the weight member/s in position in recess/es located in toe, heel and/or back side regions by pushing the weight member into the inner surface of the outer shell.

U.S. Pat. No. 4,872,685 to Sun discloses a wood type golf club head wherein a female unit is mated with a male unit to form a unitary golf club head. The female unit comprises the upper portion of the golf club head and is preferably composed of plastic, alloy, or wood. The male unit includes the structural portions of sole plate, a face insert consists of the striking plate and weighting elements. The male unit has a substantially greater weight being preferably composed of a light metal alloy. The units are mated or held together by bonding and or mechanical means.

U.S. Pat. No. 5,398,935 to Katayama discloses a wood golf club head having a striking face wherein the height of the striking face at a toe end of the golf club head is nearly equal to or greater than the height of the striking face at the center of the club head.

U.S. Pat. No. 1,780,625 to Mattern discloses a club head with a rear portion composed of a light-weight metal such as magnesium. U.S. Pat. No. 1,638,916 to Butchart discloses a golf club with a balancing member composed of persimmon or a similar wood material, and a shell-like body composed of aluminum attached to the balancing member.

Anderson, U.S. Pat. Nos. 5,024,437, 5,094,383, 5,255,918, 5,261,663 and 5,261,664 disclose a golf club head having a full body composed of a cast metal material and a face insert composed of a hot forged metal material.

Viste, U.S. Pat. No. 5,282,624 discloses a golf club head with a cast metal body and a forged steel face insert with grooves on the exterior surface and the interior surface of the face insert and having a thickness of 3 mm.

Rogers, U.S. Pat. No. 3,970,236, discloses an iron club head with a formed metal face plate insert fusion bonded to a cast iron body.

Aizawa, U.S. Pat. No. 5,242,168 discloses a golf club head having a fiber reinforced resin body with a thin metallic film layer.

Yamada, U.S. Pat. No. 4,535,990 discloses a golf club head having a fiber reinforced resin body with a face insert composed of a polycarbonate or like material.

Aizawa etal., U.S. Pat. No. 5,465,968 discloses a golf club head having a fiber reinforced resin body with a beryllium face plate.

The Rules of Golf, established and interpreted by the United States Golf Association (USGA) and The Royal and Ancient Golf Club of Saint Andrews, set forth certain requirements for a golf club head. The requirements for a golf club head are found in Rule 4 and Appendix II. A complete description of the Rules of Golf are available on the USGA web page at www.usga.org. Although the Rules of Golf do not expressly state specific parameters for a golf club face, Rule 4-1*e* prohibits the face from having the effect at impact of a spring with a golf ball. In 1998, the USGA adopted a test procedure pursuant to Rule 4-1*e* which measures club face COR. This USGA test procedure, as well as procedures like it, may bemused to measure club face COR.

Many existing high COR club heads utilize high strength titanium alloys and ultra high strength steel alloys welded to a compatible metal body. The edge of the face and the welding of the face to the body affects the COR and durability of the club head.

The elastic deflection of the face under the impact force of the ball is concentrated under the ball but extends to the edge of the face. The face under the ball and away from the impact experiences bending and stretching (tensile) strains. As long as the edge is relatively distant from the impact area the strains spread in a near uniform, dispersing pattern away from the ball. However, when the strains near the change in contour at the edge of the face, the distribution of the strains in the metal change in response to stiffness/constraint changes at the boundary. In existing clubs the edge is generally stiff and the deflection strains become concentrated stresses in the metal as the section of the metal changes from a thin plate to a near 90 degree bend. The section of the blend increases the stiffness, reduces the compliance and increases stress. In many cases, the local edge blend section experience only slight strains and through a combination of rigid body like rotation and translation pulls on (strains) the next geometric feature of the head such as the crown or sole. In these existing drivers, the closest boundary to the impact must be designed to survive the near impact. This limits the ability to design for compliance. The rounded edge shapes generally have good section stiffness. The local thickness can be reduced such that the club head will survive ball impact even at the face edge when the face material wraps around the face to create this edge. Many practical considerations limit the ability to thin or shape the structure at the edge of the face.

Existing drivers generally utilize a thick section and/or high strength material in the regions where the face first intersects the body blend to maintain acceptable durability. The thick sections reduce compliance and can adversely affect club head mass properties. Thin, high strength sections require compatible forming finishing and joining processes. These processes requirements add cost and can limit design form. Errors in the finishing and welding near the critical joints can reduce durability.

Although the prior art has disclosed many variations of multiple material club heads, the prior art has failed to provide a multiple material club head with a high coefficient of restitution and greater forgiveness for the typical golfer.

SUMMARY OF INVENTION

The present invention defines a new club head assembly and materials to create a multi-material club head that improves COR by providing lower constraint design options at the face edge and a broader use of materials away from the face.

One aspect of the present invention is a golf club head having a body composed of a lightweight material, a metal striking plate and a frame to provide an attachment means for the striking plate.

Another aspect of the present invention is a golf club head having a body, a striking plate and a frame. The body has a crown, a sole and a ribbon. The body also has an opening at a front end, a heel crown groove, a toe crown groove, a heel sole groove and a toe sole groove. The body is preferably composed of a thermoplastic material having a density less then 4.5 grams per cubic centimeter. The striking plate is positioned over the opening. The striking plate has a uniform thickness in the range of 0.040 inch to 0.250 inch. The striking plate has an upper heel hole, a lower heel hole, an upper toe hole and a lower toe hole. The striking plate insert is preferably composed of a metal material. The frame has a central body, an upper heel arm, a lower heel arm, an upper toe arm and a lower toe arm. The upper heel arm is positioned within the heel crown groove of the body to engage the upper heel hole of the striking plate. The lower heel arm is positioned within the heel sole groove of the body to engage the lower heel hole of the striking plate. The upper toe arm is positioned within the toe crown groove of the body to engage the upper toe hole of the striking plate. The lower toe arm is positioned within the toe sole groove of the body to engage the lower toe hole of the striking plate. The golf club head has a coefficient of restitution of 0.80 to 0.94, and the golf club head has a volume ranging from 300 cubic centimeters to 500 cubic centimeters.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
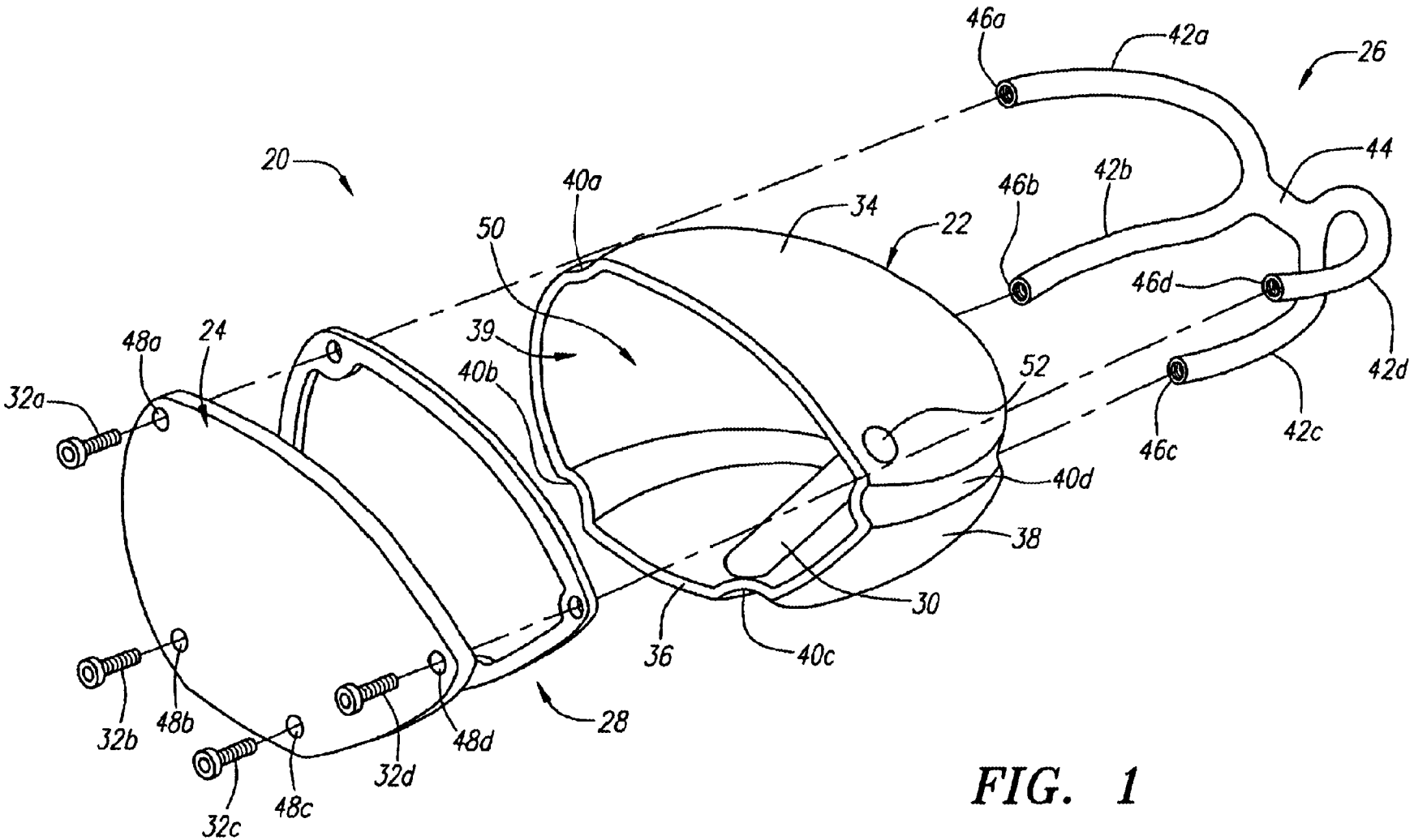
FIG. 1 is an exploded top perspective view of a preferred embodiment of a golf club of the present invention.
Figure 2:
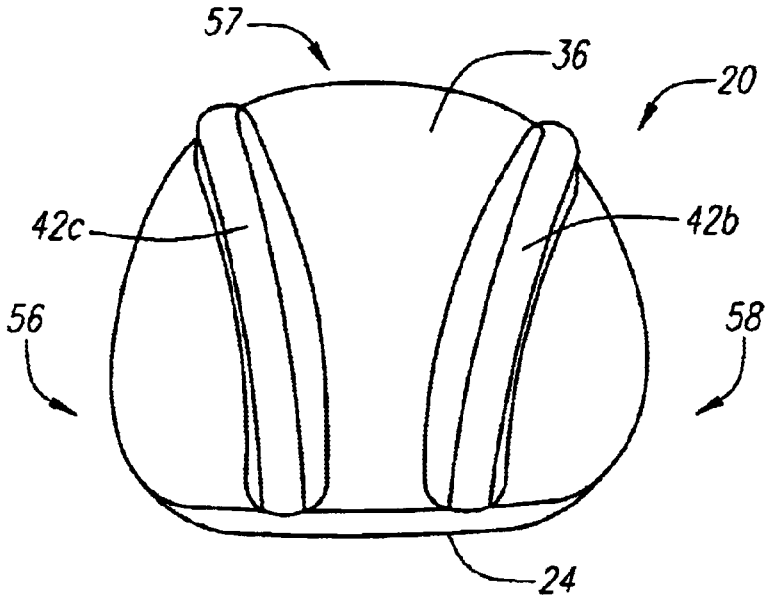
FIG. 2 is a bottom view of a golf club head of the present invention.

As shown in FIGS. 1–5, a golf club head is generally designated 20. The golf club head 20 includes a body 22, a striking plate 24 a frame 26, and an optional support gasket 28. The golf club head 20 of the present invention has a high moment of inertia about the center of gravity, CG, for forgiveness, and a high coefficient of restitution to provide greater distance when striking a golf ball.

The body 22 has a crown 34, a sole 36, a ribbon 38, an opening 39 and a plurality of grooves 40*a–d*. The body 22 preferably has a hollow interior 50, which is defined by the crown 34, the sole 36 and the ribbon 38. The golf club head 20 has a heel end 56, a toe end 58 an aft end 57. The body 22 is preferably composed of a light weight or low-density material, preferably a non-metal material or a low-density (less than 4.5 grams per cubic centimeter) metal material. A preferred non-metal material is an injectable thermoplastic material such as a polycarbonate material. Other materials for the body 22 include a composite material such as a continuous fiber pre-preg material (including thermosetting materials or a thermoplastic materials for the resin), other thermosetting materials such as thermosetting polyurethane, or other thermoplastic materials such as polyamides, polyimides, polycarbonates, PBT (Polybutylene Terephthalate), blends of polycarbonate and polyurethane, and the like. The body 22 is preferably manufactured through injection molding, bladder-molding, resin transfer molding, resin infusion, compression molding, or a similar process. A preferred metal material for the body 22 is aluminum, tin or magnesium.

The striking plate 24 is attached to the frame 26 and over the opening 39. Preferably the striking plate 24 is positioned over and attached to the support gasket 28.

The striking plate 24 is preferably composed of a formed metal material. However alternatively, the striking plate 24 is composed of a machined metal material, a forged metal material, a cast metal material or the like. The striking plate 24 preferably is composed of a formed titanium or steel material. A preferred material is steel 4340, which is heat treated and then coated with a titanium nitride. Titanium materials useful for the striking plate 24 include pure titanium and titanium alloys such as 6-4 titanium alloy, SP-700 titanium alloy (available from Nippon Steel of Tokyo, Japan), DAT 55 G titanium alloy available from Diado Steel of Tokyo, Japan, Ti 10-2-3 Beta-C titanium alloy available from RTI International Metals of Ohio, and the like. Other metals for the striking plate 24 include other high strength steel alloy metals and amorphous metals. Such steel materials include 17-4PH, Custom 450, 455, 465 and 465+ stainless steels, AERMET 100 and AERMET 310 alloy steels, all available from Carpenter Specialty Alloys, of Pennsylvania, and C35 maraging steels available from Allvac of North Carolina. Such am-orphous metals include beryllium based alloys such as disclosed in U.S. Pat. No. 5,288,344, which pertinent parts are hereby incorporated by reference, quinary metallic glass alloys such as disclosed in U.S. Pat. No. 5,735,975, which pertinent parts are hereby incorporated by reference, and ternary alloys as disclosed in *Calculations of Amorphous-Forming Composition Range For Ternary Alloy Systems And Analyses Of Stabilization Of Amorphous Phase And Amorphous-Forming Ability, Takeuchiand Inoue*, Materials Transactions, Vol. 42, No. 7, p 1435–1444 (2001), which pertinent parts are hereby incorporated by reference. The exterior surface of the striking plate 24 typically has a plurality of scorelines thereon, not shown.

The striking plate 24 preferably has an elliptical shape or a trapezoidal shape. The striking plate 24 preferably has a plurality of holes 48*a–d* for insertion of the bolts 32*a–d* therethrough.

In a preferred embodiment, the striking plate 24 has uniform thickness that ranges from 0.040 inch to 0.250 inch, more preferably a thickness of 0.080 inch to 0.120 inch, and is most preferably 0.108 inch for a titanium alloy striking plate 24 and 0.090 inch for a stainless steel striking plate 24.

The frame 26 is preferably composed of a metal material such as stainless steel, titanium alloy, aluminum, magnesium and other like metal materials. In an alternative embodiment, the frame 26 is composed of a thermoplastic material. The frame 26 is preferably composed of four arms 42*a–d* and a central body 44. In the preferred embodiment, each of the arms 42*a–d* are positioned within a corresponding groove 40*a–d* of the body 22. Each of the grooves 40*a–d* are generally shaped to receive an arm 42*a–d*. Each arm 42*a–d* has a length sufficient to extend from the aft end 57 of the body 22 to the opening 39. In a preferred embodiment, each arm 42*a–d* is tubular with a threaded aperture at the forward end (opposite the central body 44 ) to receive a bolt for attachment of the striking plate 24 thereto. The frame 26 preferably engages the striking plate 24 at each of the corners (upper heel, lower heel, upper toe and lower toe) of the striking plate 24. The frame 26 also increases the moment of inertia of the golf club head 20 since mass is positioned at the outer extremes of the golf club head 20. The attachment of the striking plate 24 to the frame 26 provides the ability to optimize the reaction points of the striking plate 24 for a greater elastic response for improved COR and moments of inertia for the golf club head 20.

Further, the attachment of the striking plate 24 to the frame 26 provides the ability to use an amorphous metal for the striking plate 24 and a different material for the frame 26 and the body 22 thereby eliminating problems associated with bonding amorphous metals to other metals. Although attachment through the use of bolts is preferred, other joining means may be utilized such as riveting, self taping screws, localized friction or welding, spot welding, local bonding, melt or solvent bonding, and the like.

Figure 6:
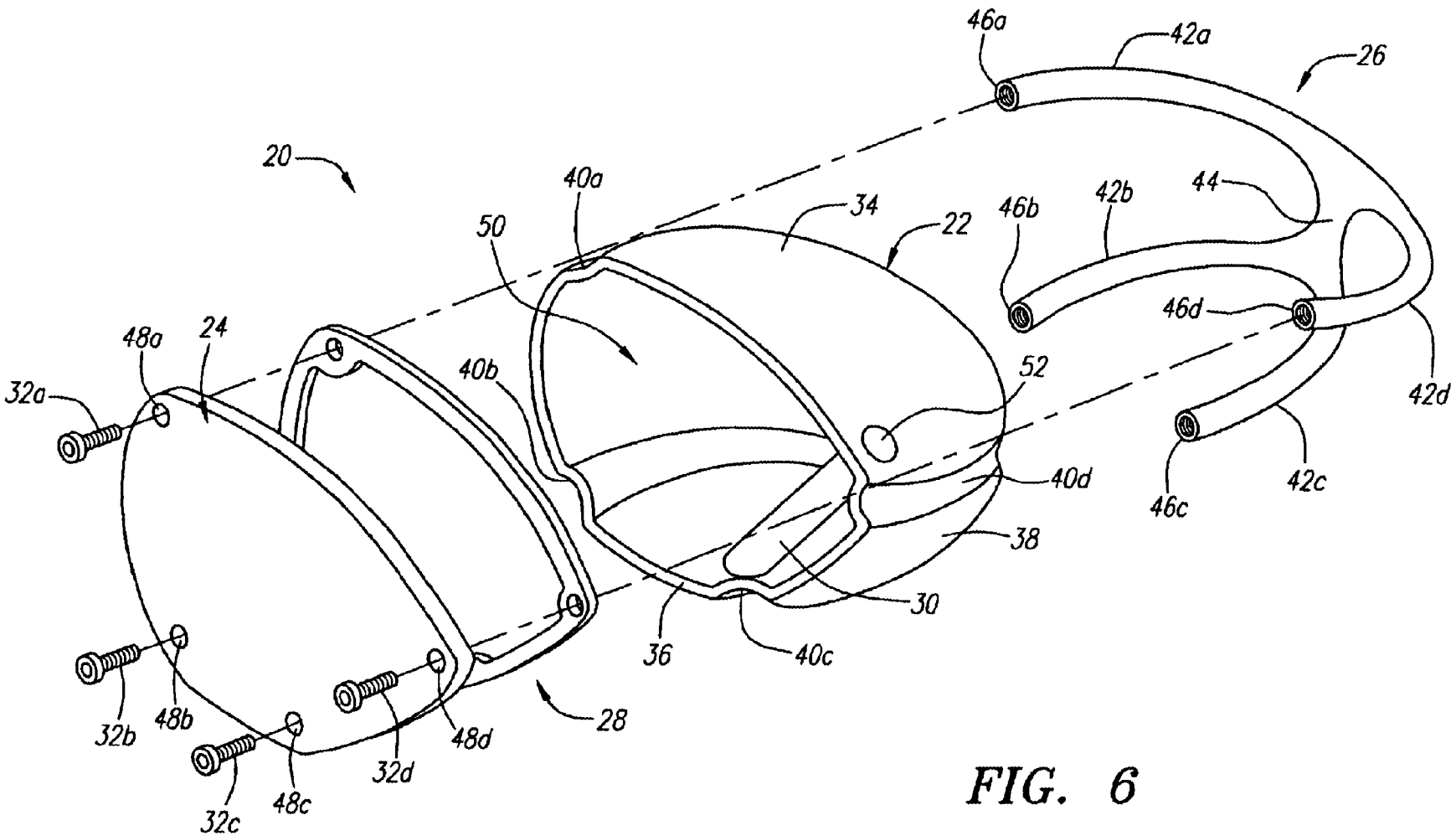
FIG. 6 is an exploded top perspective view of an alternative embodiment of the golf club of the present invention.

As shown in FIG. 1, a hosel 30 is disposed within the hollow interior 50 and is located near the heel end 56. The hosel 30 is preferably composed of an aluminum material, and preferably has a mass ranging from 3 to 10 grams, more preferably from 4 to 8 grams, and most preferably has a mass of 6 grams. Alternatively, the hosel 30 is composed of a strong polymer material such as a FIG. 6 illustrates an alternative embodiment of the golf club head 20 with the central body 44 of the frame 26 having a different configuration.

The present invention is directed at a golf club head that has a high coefficient of restitution thereby enabling for greater distance of a golf ball hit with the golf club head of the present invention. The coefficient of restitution (also referred to herein as COR) is determined by the following equation:

$$e = \frac{y_2 - y_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head 20 having a coefficient of restitution preferably ranging from 0.80 to 0.94, as measured under conventional test conditions.

The coefficient of restitution of the club head 20 of the present invention under standard USGA test conditions with a given ball preferably ranges from approximately 0.80 to 0.94, more preferably ranges from 0.82 to 0.89 and is most preferably 0.86.

The volume of the club head 20 of the present invention ranges from 250 cubic centimeters to 600 cubic centimeters, and more preferably ranges from 330 cubic centimeters to 500 cubic centimeters, even more preferably 360 cubic centimeters to 450 cubic centimeters, and most preferably 420 cubic centimeters. The volume of the golf club head 20 will also vary between fairway woods (preferably ranging from 3-woods to eleven woods) with smaller volumes and drivers, which will have larger volumes than the fairway woods.

The mass of the club head 20 of the present invention preferably ranges from 165 grams to 300 grams, more preferably ranges from 175 grams to 250 grams, even preferably from 190 grams to 225 grams, and most preferably 196 grams. Preferably, the striking plate 24 has a mass ranging from 40 grams to 90 grams, more preferably ranging from 50 grams to 80 grams, yet more preferably from 55 grams to 75 grams, and most preferably 65 grams. The body 22 (without weighting) has a mass preferably ranging from 30 grams to 100 grams, more preferably from 40 grams to 90 grams, even more preferably 60 grams to 80 grams, and most preferably 70 grams.

Preferably, the frame 26 has a mass ranging from 30 grams to 90 grams, more preferably from 40 grams to 70 grams. The hosel 30 preferably has a mass ranging from 3 to 10 grams, more preferably from 4 to 8 grams, and most preferably has a mass of 6 grams. Additionally, epoxy, or other like flowable materials, in an amount ranging from 0.5 grams to 5 grams, may be injected into the hollow interior 50 of the golf club head 20 for selective weighting thereof.

Figure 3:
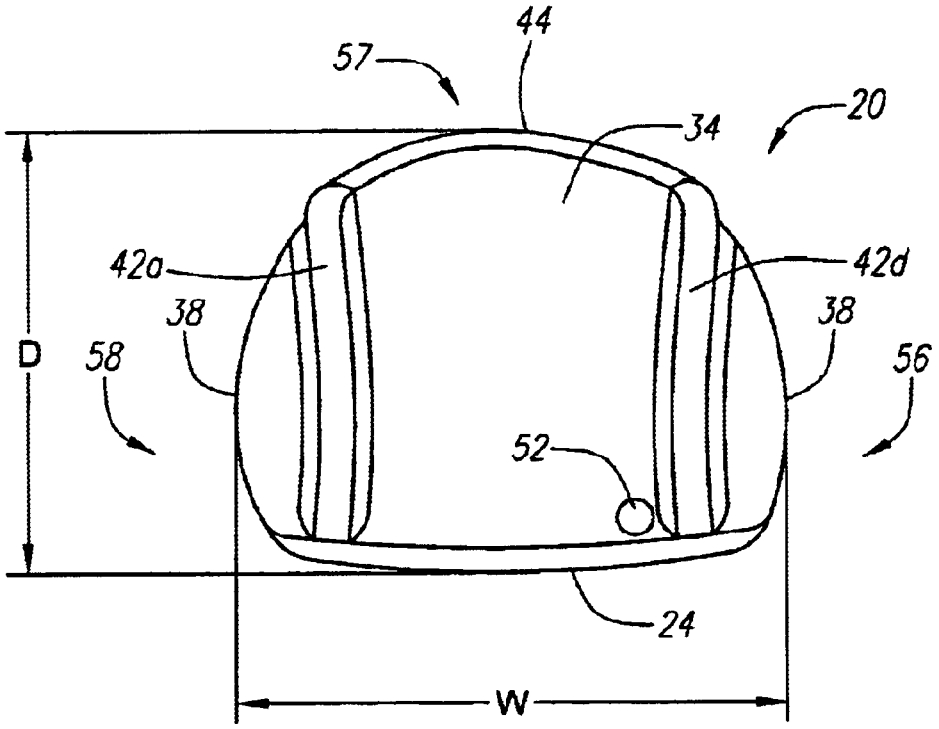
FIG. 3 is a top plan view of a golf club head of the present invention.
Figure 4:
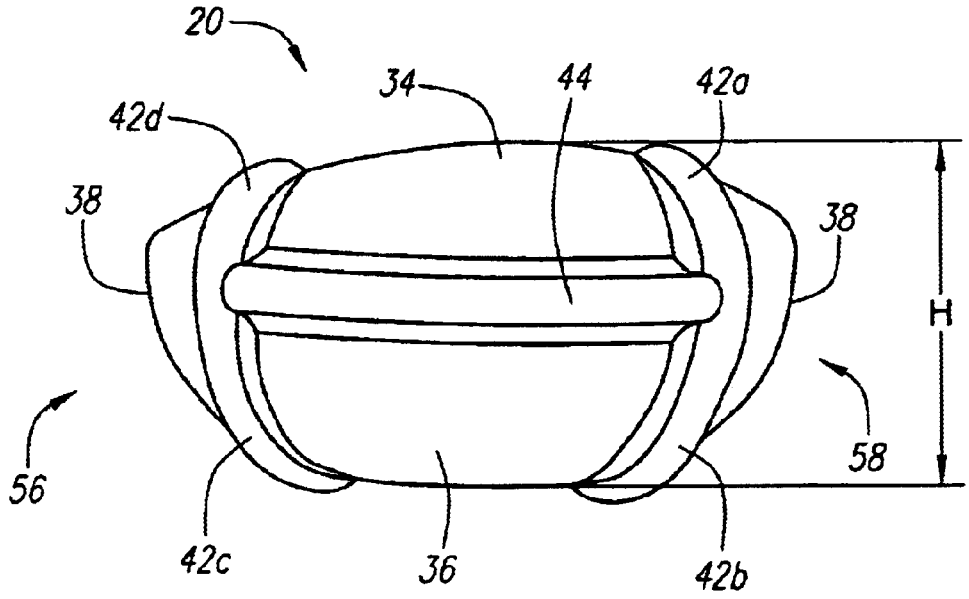
FIG. 4 is a rear plan view of a golf club head of the present invention.
Figure 5:
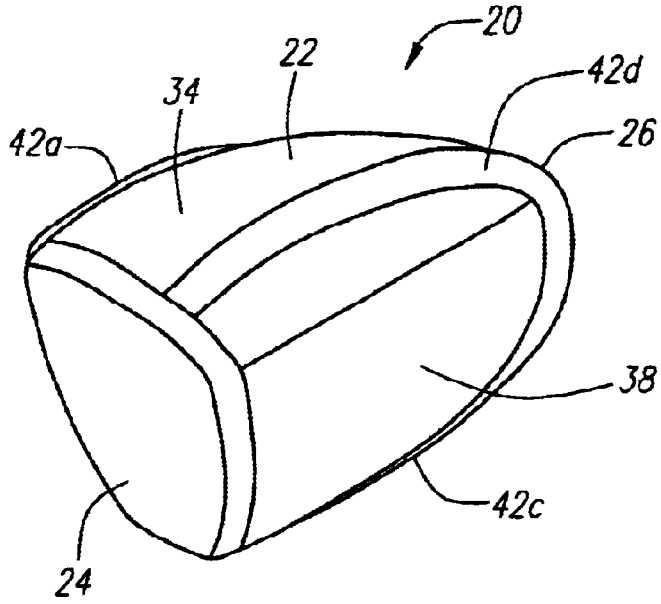
FIG. 5 is a side perspective view of a golf club head of the present invention.

As shown in FIGS. 3 and 4, the depth, D, of the club head 20 from the striking plate 24 to the after end 37 of the crown 24 preferably-ranges from 3.0 inches to 4.5 inches, and is most preferably 3.74 inches. The height, H, of the club head 20, as measured while in address position from the sole 26 to the crown 24, preferably ranges from 2.0 inches to 3.5 inches, and is most preferably 2.62 inches. The width, W, of the club head 20 from the toe end 38 to the heel end 36 preferably ranges from 4.0 inches to 5.5 inches, and more preferably 4.57 inches. The height, h, of the striking plate 24, preferably ranges from 1.8 inches to 2.5 inches, and is most preferably 2.08 inches. The width, w, of the striking plate insert from the toe end to the heel end preferably ranges from 3.0 inches to 5.0 inches, and more preferably 3.52 inches.

As defined in *Golf Club Design, Fitting, Alteration & Repair*, $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Goff Club Design, Fitting, Alteration & Repair.*

The center of gravity and the moment of inertia of a golf club head 20 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in co-pending U.S. patent application No. 09/796,951, filed on Feb. 27, 2001, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z axis for the golf club head 20 of the present invention will range from 2800 g-cm$^2$ to 5000 g-cm$^2$, preferably from 3000 g-cm$^2$ to 4500 g-cm$^2$, even more preferably from 3200 g-cm$^2$ to 4000 g-cm$^2$, and most preferably 3758 g-cm$^2$. The moment of inertia, Iyy, about the Y axis for the golf club head 20 of the present invention will range from 1500 g-cm$^2$ to 4000 g-cm$^2$, preferably from 2500 g-cm$^2$ to 3400 g-cm$^2$, even preferably from 2900 g-cm$^2$ to 3100 g-cm$^2$, and most preferably 3003 g-cm$^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A golf club head comprising:

a body having a crown, a sole and a ribbon, the body having an opening at a front end and a plurality of grooves, the body composed of a material having a density less then 4.5 grams per cubic centimeter;

a striking plate positioned over the opening, the striking plate having a uniform thickness in the range of 0.040 inch to 0.250 inch, the striking plate insert composed of a metal material; and a frame having a plurality of arms, each of the arms positioned within a corresponding groove of the body, each arm engaging the striking plate for attachment thereto;

wherein the golf club head has a coefficient of restitution of 0.80 to 0.94, and the golf club head has a volume ranging from 300 cubic centimeters to 500 cubic centimeters.

2. The golf club head according to claim 1 wherein the striking plate is composed of a formed metal material.

3. The golf club head according to claim 1 wherein striking plate is composed of a material selected from the group consisting of a forged metal material, a formed metal material, a machined metal material and a cast metal material.

4. The golf club head according to claim 1 wherein the body has a mass ranging from 50 grams to 90 grams.

5. The golf club head according to claim 1 wherein the moment of inertia about an Izz axis of the golf club head is greater than 3000 grams-centimeter squared.

6. The golf club head according to claim 1 wherein the body is composed of a material selected from the group consisting of magnesium, aluminum, polycarbonate, thermoplastic polyurethane, PBT (Polybutylene Terephthalate), blends of polycarbonate and polyurethane, carbon epoxy and plies of pre-preg.

7. The golf club head according to claim 1 wherein the striking plate is composed of a material selected from the group consisting of amorphous metals, titanium alloys, stainless steel and carbon steel.

8. A golf club head comprising:

a body having a crown, a sole and a ribbon, the body having an opening at a front end and a plurality of grooves, the body composed of a thermoplastic material having a density less then 4.5 grams per cubic centimeter;

a striking plate positioned over the opening, the striking plate having a uniform thickness in the range of 0.040 inch to 0.250 inch, the striking plate insert composed of a metal material; and a frame having a plurality of arms and a central body, each of the arms positioned within a corresponding groove of the body and the central body engaging an aft end of the body, each arm engaging the striking plate for attachment thereto, the frame composed of a metal material;

wherein the golf club head has a coefficient of restitution of 0.80 to 0.94, and the golf club head has a volume ranging from 300 cubic centimeters to 500 cubic centimeters.

9. A golf club head comprising:

a body having a crown, a sole and a ribbon, the body having an opening at a front end, the body having a heel crown groove, a toe crown groove, a heel sole groove and a toe sole groove, the body composed of a thermoplastic material having a density less then 4.5 grams per cubic centimeter;

a striking plate positioned over the opening, the striking plate having a uniform thickness in the range of 0.040 inch to 0.250 inch, the striking plate having an upper heel hole, a lower heel hole, an upper toe hole and a lower toe hole, the striking plate insert composed of a metal material; and a frame having a central body, an upper heel arm, a lower heel arm, an upper toe arm and a lower toe arm, wherein the upper heel arm is positioned within the heel crown groove of the body to engage the upper heel hole of the striking plate, wherein the lower heel arm is positioned within the heel sole groove of the body to engage the lower heel hole of the striking plate, wherein the upper toe arm is positioned within the toe crown groove of the body to engage the upper toe hole of the striking plate, wherein the lower toe arm is positioned within the toe sole groove of the body to engage the lower toe hole of the striking plate;

wherein the golf club head has a coefficient of restitution of 0.80 to 0.94, and the golf club head has a volume ranging from 300 cubic centimeters to 500 cubic centimeters.

10. The golf club head according to claim 9 further comprising a plurality of fasteners for attaching the striking plate to the frame.

* * * * *